US007152585B2

(12) United States Patent
Tanaka

(10) Patent No.: US 7,152,585 B2
(45) Date of Patent: Dec. 26, 2006

(54) FUEL INJECTION PUMP WITH COLD START DEVICE

(75) Inventor: Masamichi Tanaka, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 10 days.

(21) Appl. No.: 11/295,443

(22) Filed: Dec. 7, 2005

(65) Prior Publication Data

US 2006/0107929 A1 May 25, 2006

Related U.S. Application Data

(63) Continuation of application No. PCT/JP2004/006221, filed on Apr. 28, 2004.

(30) Foreign Application Priority Data

Jun. 12, 2003 (JP) ..... 2003-167945

(51) Int. Cl.
*F02M 37/04* (2006.01)

(52) U.S. Cl. ..... 123/500; 123/179.17

(58) Field of Classification Search ..... 123/500, 123/179.17, 501, 506, 514, 357, 449
See application file for complete search history.

(56) References Cited

U.S. PATENT DOCUMENTS 4,409,939 A * 10/1983 Eheim et al. ..... 123/357
4,619,233 A * 10/1986 Yamaguchi ..... 123/357
4,754,737 A * 7/1988 Ishida et al. ..... 123/500
5,219,280 A * 6/1993 Yashiro ..... 417/499
5,638,793 A * 6/1997 Rapp et al. ..... 123/500
5,647,326 A * 7/1997 Kato et al. ..... 123/500
5,911,207 A * 6/1999 Ohishi et al. ..... 123/299
6,032,641 A * 3/2000 Aketa et al. ..... 123/299
6,082,335 A * 7/2000 Kampichler et al. ..... 123/500
6,866,025 B1 * 3/2005 Maass ..... 123/450
6,880,508 B1 * 4/2005 Tanaka et al. ..... 123/179.17

FOREIGN PATENT DOCUMENTS

JP 2000-234576 8/2000
JP 2003-090275 3/2003

OTHER PUBLICATIONS

International Search Report for International Application No. PCT/JP2004/006221, Japanese Patent Office, mailed Jul. 6, 2004.

* cited by examiner

*Primary Examiner*—Carl S. Miller
(74) *Attorney, Agent, or Firm*—Sterne, Kessler, Goldstein & Fox P.L.L.C.

(57) ABSTRACT

A fuel injection pump comprises: a barrel formed with a main port 39 and a sub port 36*a*; a plunger 32; and a CSD 30 including an injection-advancing actuator 38 which operates a piston 35 for opening or closing sub port 36*a* so as to change an injection timing. Plunger 32 is moved to connect or separate sub port 36*a* and main port 39 to and from a fuel compression chamber 17. The barrel is further formed with at least one exclusive overflowing sub port 36*b* constantly opened regardless of the operational state of the piston 35.

1 Claim, 6 Drawing Sheets

FUEL INJECTION PUMP WITH COLD START DEVICE

CROSS-REFERENCE TO RELATED APPLICATION

The present application is a Continuation of PCT Application No. PCT/JP2004/006221, filed Apr. 28, 2004, which is hereby incorporated in its entirety herein by reference thereto.

BACKGROUND OF THE INVENTION

1. Field of the Invention

The present invention relates to a fuel injection pump with a cold start device for advancing fuel injection to a diesel engine when being started up in a low temperature, and particularly, to a technology for optimizing the fuel injection timing and quantity during the engine start-up in a low temperature.

2. Background Art

Conventionally, there are well-known fuel injection pumps for diesel engines, each comprising a plunger, a plunger barrel, a distribution shaft, and delivery valves, wherein the plunger is vertically reciprocated in the plunger barrel to discharge compressed fuel to the distribution shaft, the distribution shaft distributes the fuel from the plunger among the delivery valves, and the delivery valves deliver fuel to respective fuel injection nozzles.

Some of the well-known fuel injection pumps each includes a device for advancing fuel injection to a diesel engine when being started up in a low temperature ("Cold Start Device," hereinafter referred to as "CSD"), wherein the CSD operates an injection-advancing actuator for opening or closing an overflowing sub port formed in the plunger barrel so as to change the injection timing. As disclosed in Japanese Laid Open Gazette No. 2000-234576, when the engine is started up in a low temperature, the CSD is activated to close the overflowing sub port so as to advance the fuel injection timing, thereby optimizing the start-up of the engine.

When the CSD is activated for injection-advancing, the injection-advancing actuator actuates a piston for closing the overflowing sub port which is opened in a normal temperature. Accordingly, the discharge of compressed fuel from a fuel compression chamber to the distribution shaft is started immediately the plunger shuts off a main port from the fuel compression chamber.

However, with respect to the conventional fuel injection pump, the change degrees of the advanced injection timing and quantity during closing of the overflowing sub port (activation of the CSD) from those during opening of the overflowing sub port (inactivation of the CSD) are univocally decided depending on the positional setting of the overflowing sub port in the plunger barrel relative to the main port and depending on the diameter size of the overflowing sub port. This is the reason why optimization of the engine start-up during activation of the CSD (in a low temperature or a cold engine condition) while ensuring the require engine performance during activation of the CSD (in a normal temperature or a warmed engine condition) is difficult.

BRIEF SUMMARY OF THE INVENTION

According to the invention, a fuel injection pump comprises: a barrel formed with a main port and a sub port; a plunger; and a cold start device including an injection-advancing actuator which operates a piston for operating or closing the sub port so as to change an injection timing in correspondence to temperature. The plunger is moved to connect or separate the sub port and the main port t and from a fuel compression chamber. The barrel is further formed with at least one exclusive overflowing sub port constantly opening regardless of the operational state of the piston. The exclusive overflowing sub port is disposed between the main port and the sub port opening and closed by the piston in the slide direction of the plunger so that the positional difference of the sub port being able to be opened and closed and the exclusive overflowing sub port in the slide direction of the plunger defines the change degree of injection timing. The position and diameter of the exclusive overflowing sub port are adjusted to adjust the change degree of injection timing and quantity. Due to the positional setting of the exclusive overflowing sub port, the change degrees of the advanced injection timing and quantity during closing of the overflowing sub port (activation of the CSD) from those during opening of the overflowing sub port (inactivation of the CSD) can be optionally decided so as to optimize the engine start-up during activation of the CSD (in a low temperature or a cold engine condition) while ensuring the engine characteristic during inactivation of the CSD (in a normal temperature or a warmed engine condition). Further, while ensuring the engine characteristic during inactivation of the CSD (in a normal temperature or a warmed engine condition), has small change degrees of the advanced injection timing and quantity during closing of the overflowing sub port (activation of the CSD) in comparison with the conventional fuel injection pump. In this way, the engine start-up in a low temperature, NOx and black smoke in exhaust gas and noise can be reduced and the start-up time can be shortened, thereby improving the general engine performance.

BRIEF DESCRIPTION OF THE DRAWINGS/FIGURES

Figure 5:
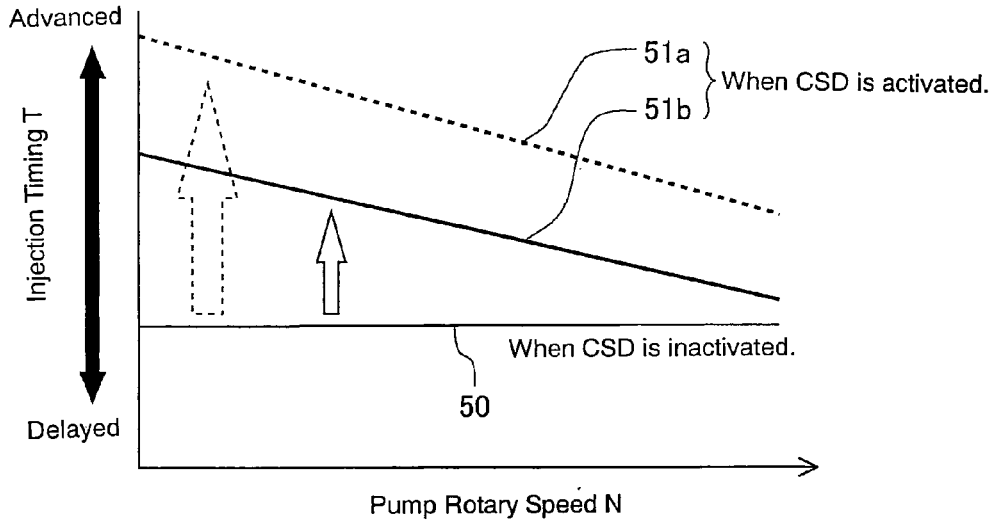

FIG. 5 graphs fuel injection timing variations relative the pump rotary speed.

Figure 6:
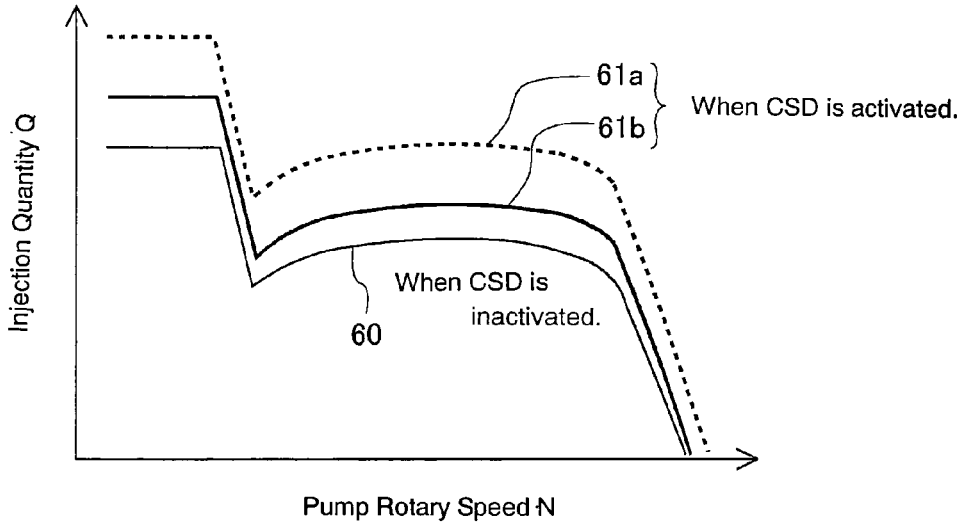

FIG. 6 graphs fuel injection quantity variations relative to the pump rotary speed.

DETAILED DESCRIPTION OF THE INVENTION

A fuel injection pump 1 according to the invention is mounted on a diesel engine. An embodiment of fuel injection pump 1 will be described on the assumption that the left side of FIG. 1 is regarded as the front side of fuel injection pump 1.

Figure 1:
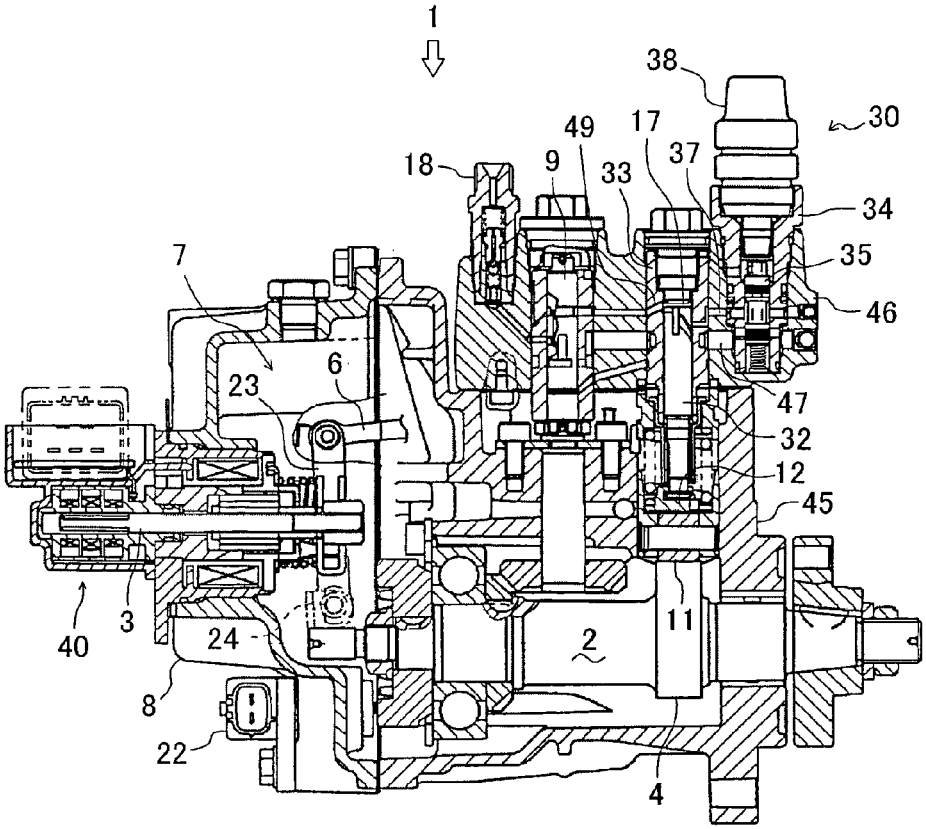
FIG. 1 is a sectional side view of a fuel injection pump according to the invention.

As shown in FIG. 1, fuel injection pump 1 comprises a pump housing 45 and a hydraulic head 46 which are vertically joined to each other. A casing 8 of an electronic governor 7 is attached onto a front side surface of pump housing 45. A rack actuator 40 is fixedly inserted rearward into casing 8. Governor 7 does not have to be an electronic governor, and may be replaced with a mechanical governor.

Rack actuator 40 moves a slide shaft 3 forward or rearward. Slide shaft 3 is pivotally connected at a tip thereof to an intermediate portion of a governor lever 23.

Governor level 23 is pivoted at a lower portion thereof on a governor lever shaft 24. A link 6 is pivotally connected to a top portion of governor lever 23, so that governor lever 23 rotates forward or rearward about governor level shaft 24 according to the forward or rearward movement of slide shaft 3, and therefore, link 6 moves forward or backward so as to move a governing rack (not shown) for rotating a plunger 32, thereby increasing or decreasing the fuel injection quantity.

Figure 2:
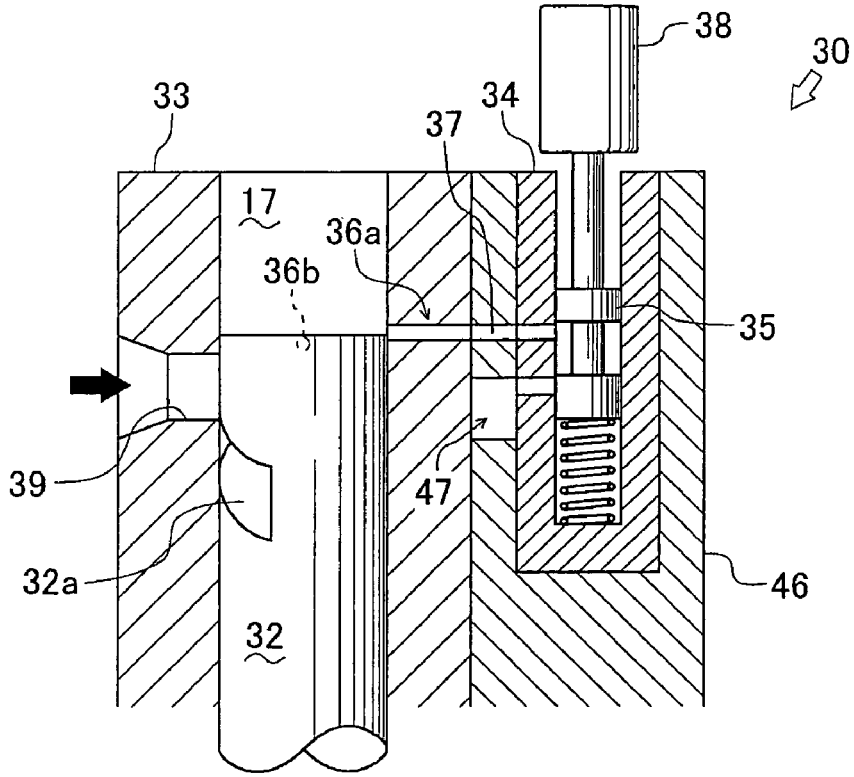
FIG. 2 is a sectional view of a CSD.

As shown in FIGS. 1 and 2, a plunger barrel 33 is fitted in hydraulic head 46, and a plunger 32 is vertically slidably fitted in plunger barrel 33. Plunger 32 is vertically reciprocated by rotation of a cam 4 formed on a pump camshaft 2 via a tappet 11 and a lower spring stay 12. A space above plunger 32 serves as a fuel compression chamber 17 in which fuel is compressed to be supplied to a distribution shaft 9.

A rotary sensor 22 is attached onto a lower portion of casing 8 so as to detect the rotary speed of pump camshaft 2.

A cold start device (hereinafter, referred to as "CSD 30") is disposed in hydraulic head 46 behind plunger barrel 33. A piston barrel 34 of CSD 30 is fitted in hydraulic head 46. Piston barrel 34 includes a piston slide portion in which a CSD timer piston (hereinafter, referred to as "piston 35") is vertically slidably fitted. An injection-advancing actuator 38 vertically slides piston 35. Injection-advancing actuator 38 may be composed of an electromagnetic actuator, which is electronically controlled by a controller connected to a water temperature sensor or the like to correspond to a water temperature, or a thermo-sensing member such as a thermostat extended and contracted by sensing a temperature change, or the like.

As shown in FIG. 2, an overflowing sub port (hereinafter, referred to as "sub port 36*a*") is formed in plunger barrel 33 and connected to piston barrel 34 via a drain fuel passage 37.

CSD 30 is inactivated in a normal temperature (in a warmed engine condition). In this state, piston 35 is disposed at the lowest position so as to connect sub port 36*a* to a low-pressure chamber 47 via drain fuel passage 37. Accordingly, a part of fuel to be compressed by plunger 32 is overflowed to low-pressure chamber 47 formed in hydraulic head 46, as as to set a normal fuel injection timing.

When an engine is started up in a low temperature (in a cold engine condition), CSD 30 is activated to activate injection-advancing actuator 38 for moving piston 35 upward, thereby dividing drain fuel passage 36*a* so as to separate sub port 36*a* from low pressure chamber 47. In this way, the fuel injection is quickened, i.e., the fuel injection timing is advanced.

With respect to fuel injection pump 1 having the above structure, a fuel injection system and a system of CSD 30 will be detailed as follows with reference to FIGS. 1 and 2.

A main port 39 is formed in plunger barrel 33 and constantly supplied with fuel charged from a fuel supply portion. When plunger 32 reaches the lowest position (lower dead point) of the reciprocation range thereof, fuel compression chamber 17 formed in plunger barrel 33 above plunger 32 is connected to main port 39 so as to be supplied with fuel. Then, plunger 32 is pushed upward by cam 4, and the outer wall thereof shuts off the opening of main port 39 from fuel compression chamber 17. Accordingly, rising plunger 32 discharges the fuel in fuel compression chamber 17 from a distribution post 49 penetrating plunger barrel 33 to delivery valves 18 via distribution shaft 9, and fuel from delivery valves 18 is injected into respective cylinders of an engine via respective fuel injection nozzles provided in a cylinder head of the engine.

When plunger 32 further rises, a plunger head 32*a* formed in plunger 32 is connected to main port 39 so as to connect main port 39 to fuel compression chamber 39, thereby backflowing the fuel from fuel compression chamber 17 to main port 39 on the fuel supply portion side. Electronic governor 7 can rotate plunger 32 so as to change the vertical position of plunger 32 for connecting plunger lead 32*a* to main port 39, thereby adjusting the fuel injection quantity from the fuel injection nozzles.

Sub port 36*a*, which can be opened or closed by sliding piston 35 of CSD 30 as mentioned above, is disposed opposite to main port 39, and diametrically smaller than main port 39.

The engine, when being started up in a low temperature, requests the fuel injection timing to be advanced. Therefore, CSD 30 is activated for advancing the injection timing. In this regard, injection-advancing actuator 38 moves piston 35 to divide drain fuel passage 37 so as to separate sub port 36*a* from piston barrel 34. Consequently, the discharge of fuel from fuel compression chamber 17 to distribution shaft 9 is started immediately plunger 32 shuts off main port 39 from fuel compression chamber 17.

On the other hand, in a normal temperature, CSD 30 is inactivated so as to connect piston barrel 34 to sub port 6*a* via drain fuel passage 37, i.e., to connect low-pressure chamber 47 to sub port 36*a*. Therefore, fuel is drained from sub port 36*a* so as to delay the start of the discharge of fuel from fuel compression chamber 17, i.e., to delay fuel injection.

Figure 3:
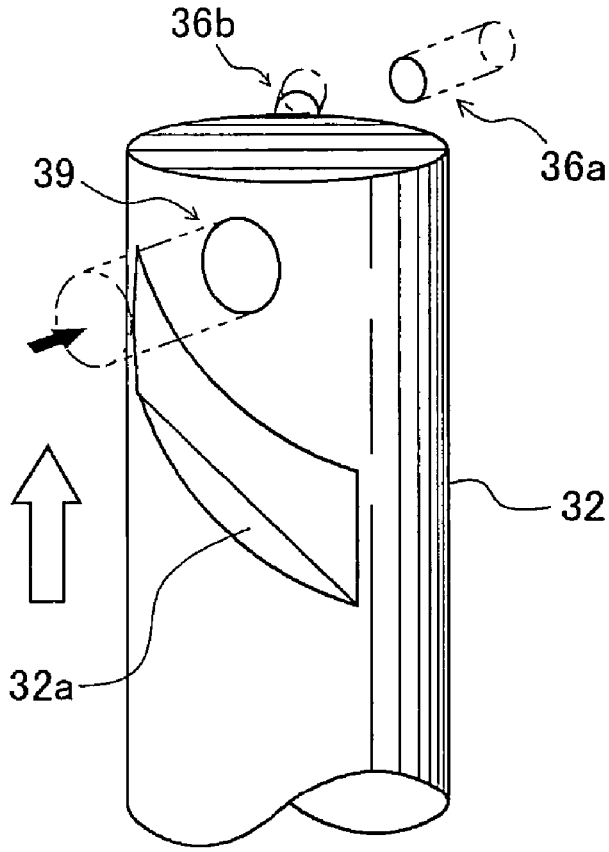
FIG. 3 is a perspective view of an upper portion of a rising plunger.

Further, according to the present invention, as shown in FIG. 3, an exclusive overflowing sub port 36*b* constantly opened regardless of the activation/inactivation condition of CSD 30 is provided in addition to sub port 36*a* which can be opened or closed by CSD 30. Exclusive overflowing sub port 36*b* is formed in plunger barrel 33 above main port 39 and below sub port 36*a*. In other words, exclusive overflowing sub port 36*b* is disposed between main port 39 and sub port 36*a* in the slide direction of plunger 32. Exclusive overflowing sub port 36*b* is adapted to optimize the change degrees of advanced injection timing and injection quantity during activation of CSD 30 from those during inactivation of CSD 30.

The injection quantity variation and injection timing variation of fuel from fuel compression chamber 17 due to exclusive overflowing sub port 36*b* during activation of CSD 30 and the variations thereof during inactivation of CSD 30 will be described with reference to FIG. 4.

Figure 4:
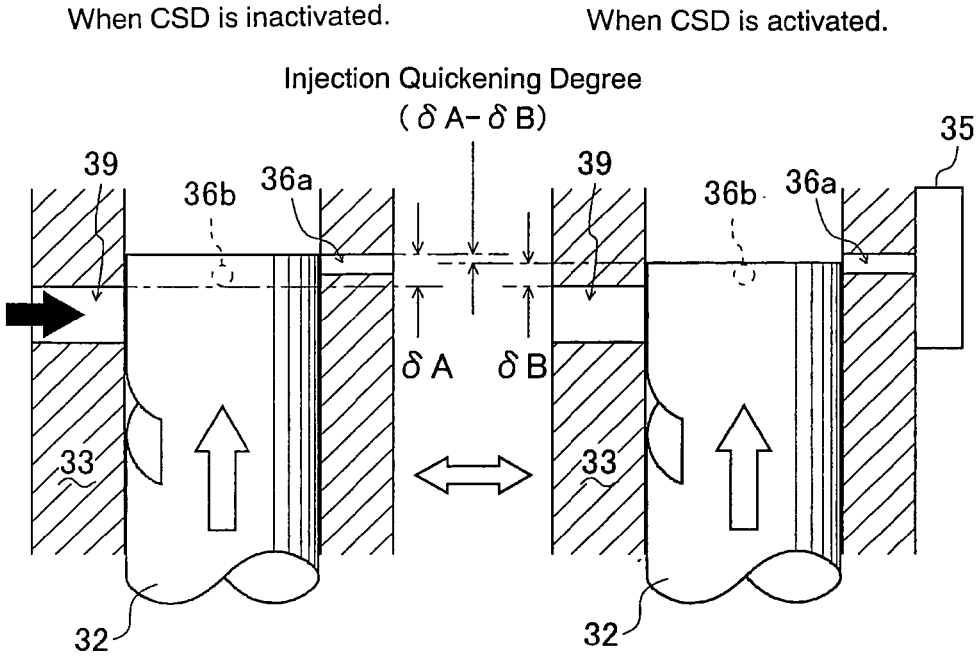
FIG. 4 illustrates partly sectional side views of the upper portion of the rising plunger during activation of the CSD and during inactivation of the CSD, respectively.

As a left view in FIG. 4, during inactivation of CSD 30, i.e., in a normal temperature, sub port 36*a*, which is not closed by piston 35, connects sub port 36*a* to low-pressure chamber 47, so as to let fuel overflow from sub port 36*a* and exclusive overflowing sub port 36*b*. During rising of plunger 32, the outer wall of plunger 32 separates fuel compression chamber 17 from main port 39, and then closes sub port 36*a* so as to discharge fuel from fuel compression chamber 17 to distribution shaft 9. In this regard, the variations of fuel injection quantity and timing during inactivation of CSD 30 are decided due to the position of sub port 36*a*, regardless of whether or not exclusive overflowing sub port 36*b* is provided.

On the other hand, as a right view in FIG. 4, during activation of CSD 30, i.e., during engine start-up in a low temperature, sub port 36*a* closed by piston 35 separates sub port 36*a* from low-pressure chamber 47, so as to prevent fuel from overflowing from sub port 36*a*, but to let fuel overflow from only exclusive overflowing sub port 36*b*. In this case, exclusive overflowing sub port 36*b* serves as sub port 36*a* for the inactivation condition of CSD 30. The fuel injection timing is decided due to the position of exclusive overflowing sub port 36*b* to be closed by rising plunger 32. In other words, the fuel injection timing is advanced due to exclusive overflowing sub port 36*b*, so that the fuel injection timing and quantity are defined by the position (height) and diameter of exclusive overflowing sub port 36*b*.

A plunger stroke δ A designates a stroke of rising plunger 32 from the position for closing main port 39 to the position for closing sub port 36*a*, and a plunger stroke δ B designates a stroke of rising plunger 32 from the position for closing main port 39 to the position for closing exclusive overflowing sub port 36*b*. Plunger stroke δ A defines the fuel injection timing and quantity during inactivation of CSD 30. Plunger stroke δ A defines the fuel injection timing and quantity during activation of CSD 30. Consequently, the advanced degree of fuel injection timing corresponds to the difference between plunger stroke δ A during inactivation of CSD 30 and plunger stroke δ B during inactivation of CSD 30, that is, "δ A–δ B".

During inactivation of CSD 30, plunger stroke δ A exists regardless of existence of exclusive overflowing sub port 36*b*. During activation of CSD 30, plunger stroke δ B does not exist (δ B=0) without exclusive overflowing sub port 36*b*, that is, plunger stroke δ B is caused by the existence of exclusive overflowing sub port 36*b* according to the present invention. In other words, due to exclusive overflowing sub port 36*b* and activation of CSD 30, the position of plunger 32 for starting discharge of fuel from fuel compression chamber 17, such as to cause plunger stroke δ A, is lowered to the position such as to cause plunger stroke δ B. More specifically, in the conventional structure, the advanced degree of fuel injection timing caused by activation of CSD 30 is univocally decided as plunger stroke δ A depending on the position of sub port 36*a*. On the contrary, according to the prevent invention, optional positioning of exclusive overflowing sub port 36*b* makes plunger stroke δ B variable, so as to optionally set the plunger stroke difference δ A−δ B. Namely, the injection-advancing degree during activation of CSD 30 can be optionally set by setting plunger stroke difference δ A–δ B within a range not less than 0 and not more than δ A.

FIG. 5 illustrates a graph of fuel injection timing T relative to pump rotary speed N of fuel injection pump 1 due to the present structure with exclusive overflowing sub port 36*b* in comparison with a graph of the same due to the conventional structure without exclusive overflowing sub port 36*b*. FIG. 6 illustrates a graph of fuel injection quantity Q relative to pump rotary speed N of fuel injection pump 1 due to the present structure with exclusive overflowing sub port 36*b* in comparison with a graph of the same due to the conventional structure without exclusive overflowing sub port 36*b*.

Referring to FIG. 5, as expressed by a timing characteristics 50, injection timing T during inactivation of CSD 30 is kept substantially constant against variation of pump rotary speed N of fuel injection pump 1. Due to activation of CSD 30, injection timing T is advanced, i.e., the fuel injection is quickened. A timing characteristics 51*b* during activation of CSD 30 according to the present invention has a slope whose angle is substantially equal to that of a slope of a timing characteristics 51*a* during activation of CSD 30 according to the conventional structure. However, the change degree of advanced injection timing T expressed by timing characteristics 51*b* from injection timing T during inactivation of CSD 30 expressed by timing characteristics 50 is smaller than the change degree of advanced injection timing T expressed by timing characteristics 51*a* from injection timing T during inactivation of CSD 30. Namely, during activation of CSD 30, the injection advancing degree by the invention is smaller than that by the conventional structure.

Referring to FIG. 6, a characteristics 61*b* expressing injection quantity Q relative to pump rotary speed N due to exclusive overflowing sub port 36*b* according to the present invention is shaped substantially similar to a characteristics 60 during inactivation of CSD 30 and a characteristics 61*a* due to the conventional structure during activation of CSD 30. However, the change degree of injection quantity Q expressed by characteristics 61*b* from injection quantity Q during inactivation of CSD 30 expressed by characteristics 60 is smaller than the change degree of injection quantity Q due to the conventional structure from injection quantity Q during inactivation of CSD 30.

Consequently, the advanced degree and quantity of fuel injection relative to pump rotary speed N, which are univocally decided by the position of sub port 36*a* or the like in the conventional structure, can be optionally decided according to positioning of exclusive overflowing sub port 36*b* or the like.

In this embodiment, only one exclusive overflowing sub port 36*b* is provided. Alternatively, a plurality of exclusive overflowing sub ports 36*b* may be provided. That is to say, according to the present invention, exclusive overflowing sub port 36*b* can be adjusted in position and diametrical size, so as to adjust the fuel injection timing and the overflowing quantity of fuel from exclusive overflowing sub port 36*b* within the whole allowable ranges thereof during activation of CSD 30 in correspondence to those during inactivation of CSD 30 ensured by positioning of sub port 36*a*, so as to optimize the fuel injection advancing degree and the fuel injection quantity during activation of CSD 30.

In this way, the positional setting of exclusive overflowing sub pot 36*b* in plunger barrel 33 enables optional setting of the fuel injection timing and quantity so as to suit for any of different engines including respective fuel injection pumps 1 with standardized CSDs 30 and sub ports 36*a*. In other words, with respect to the present fuel injection pump 1, while the required characteristic during inactivation of CSD 30 (in a normal temperature or in a warmed engine condition) is ensured, the change degrees of fuel injection timing and quantity during activation of CSD 30 from those during inactivation of CSD 30 are made to be smaller than the change degrees of fuel injection timing and quantity of the conventional type fuel injection pump during activation of CSD 30 from those during inactivation of CSD 30, thereby optimizing the engine start-up in a low temperature while ensuring the engine performance in a normal temperature. Consequently, when the engine is started up in a low temperature, NOx and black smoke in exhaust gas and noise are reduced and the required time for starting up the engine is shortened, thereby improving general performance of the engine.

INDUSTRIAL APPLICABILITY

As mentioned above, the invention is broadly applicable to diesel engines equipped with fuel injection with cold start devices.

What is claimed is:

1. A fuel injection pump comprising:

a barrel formed with a main port and a sub port;

a plunger; and a cold start device including an injection-advancing actuator which operates a piston for opening or closing the sub port so as to change an injection timing in correspondence to temperature, wherein the plunger is moved to connect or separate the sub port and the main port to and from a fuel compression chamber, characterized in that the barrel is further formed with at least one exclusive overflowing sub port constantly opened regardless of the operational state of the piston, wherein the exclusive overflowing sub port is disposed between the main port and the sub port opened and closed by the piston in the slide direction of the plunger so that the positional difference of the sub port being able to be opened and closed and the exclusive overflowing sub port in the slide direction of the plunger defines the change degree of injection timing, and wherein means to adjust the position and diameter of the exclusive overflowing sub port are provided to adjust the change degree of injection timing and quantity.

* * * * *